US007252135B2

(12) United States Patent
Noguchi et al.

(10) Patent No.: US 7,252,135 B2
(45) **Date of Patent: *Aug. 7, 2007**

(54) COMPOSITE METAL MATERIAL AND METHOD OF PRODUCING THE SAME

(75) Inventors: Toru Noguchi, Ueda (JP); Akira Magario, Chisagatagun (JP)

(73) Assignee: Nissin Kogyo Co., Ltd., Nagano (JP)

( * ) Notice: Subject to any disclaimer, the term of this patent is extended or adjusted under 35 U.S.C. 154(b) by 99 days.

This patent is subject to a terminal disclaimer.

(21) Appl. No.: 11/041,258

(22) Filed: Jan. 25, 2005

(65) Prior Publication Data

US 2005/0194115 A1 Sep. 8, 2005

(30) Foreign Application Priority Data

Jan. 29, 2004 (JP) ..... 2004-021146

(51) Int. Cl.
*B22D 19/14* (2006.01)

(52) U.S. Cl. ..... 164/97; 428/614

(58) Field of Classification Search ..... 164/97, 164/98; 428/614
See application file for complete search history.

(56) References Cited

U.S. PATENT DOCUMENTS 4,818,633 A * 4/1989 Dinwoodie et al. ..... 428/614
5,458,181 A 10/1995 Corbett et al.
2004/0241440 A1* 12/2004 Noguchi et al. ..... 428/364
2005/0075443 A1* 4/2005 Noguchi et al. ..... 524/495
2005/0192396 A1* 9/2005 Noguchi et al. ..... 524/495

FOREIGN PATENT DOCUMENTS

| | | |
|---|---|---|
| EP | 1 179 607 A2 | 2/2002 |
| EP | 1 500 677 A2 | 1/2005 |
| JP | A 2002-115017 | 4/2002 |
| JP | A-2005-82614 | 3/2005 |
| JP | A-2005-97534 | 4/2005 |
| KR | 00256365 B1 | 2/2000 |
| WO | WO 90/10296 A1 | 9/1990 |
| WO | WO 02/076888 A1 | 10/2002 |
| WO | WO 03/060002 A1 | 7/2003 |

OTHER PUBLICATIONS

U.S. Appl. No. 10/895,351, filed Jul. 21, 2004, Noguchi et al.
U.S. Appl. No. 11/046,249, filed Jan. 31, 2005, Noguchi et al.
Noguchi et al., "Structure and Properties for Carbon Nanofiber/Elastomer Nanocomposites," Sep. 10, 2003, 52d SPSJ Symposium on Macromolecules, pp. 1785-1786, (with English-language translation of relevant protions).

(Continued)

*Primary Examiner*—Kevin P. Kerns
(74) *Attorney, Agent, or Firm*—Oliff & Berridge, PLC

(57) ABSTRACT

A method of producing a composite metal material includes: (a) mixing an elastomer and filler particles to obtain a composite material; and (b) mixing the composite material and a metal to obtain a composite metal material in which the filler particles are uniformly dispersed in the metal.

14 Claims, 3 Drawing Sheets

OTHER PUBLICATIONS

Magario et al., "Structure and Properties for Carbon Nanofiber/Aluminium Nanocomposites," Oct. 11, 2003, 133d Collected Abstracts of the 2004 Autumn Meeting of The Japan Institute of Metals, pp. 566, (with English-language translation of relevant portions).

T. Noguchi, "Carbon Nanotube/Aluminium Composites with Uniform Dispersion," Feb. 20, 2004, Materials Transactions, No. 2, vol. 45, pp. 602-604, (with English-language translation of relevant portions).

Noguchi et al., "Dynamic Properties for CNT/A1 Nanocomposites," Mar. 30, 2004, 134th Collected Abstracts of the 2004 Spring Meeting of The Japan Institute of Metals, pp. 353, (with English-language translation of relevant portions).

Magario et al., "Structure and Thermal Properties for CNT/A1 Nanocomposites," Mar. 30, 2004, 134th Collected Abstracts of the 2004 Spring Meeting of The Japan Institute of Metals, pp. 353, (with English-language translation of relevant portions).

Noguchi et al., "Preparation and Properties of Aluminum Nanocomposites by Matrix Substitution of Carbon Nanotube/Elastomer Composites," May 20, 2004, 71st The Society of Rubber Industry, Japan Annual Meeting, pp. 30, (with English-language translation of relevant portions).

Noguchi et al., "Development of Carbon Nanotubes/Aluminum Composites and Expectation as Lightweigh Member," Aug. 1, 2004, Engineering Materials, vol. 52, No. 8, (with English-language translation of relevant portions).

Magario et al., "CNT Peripheral Structure of CNT/A1 Nanocomposites," Sep. 28, 2004, 135th Collected Abstracts of the 2004 Autumn Meeting of The Japan Institute of Metals, pp. 568, (with English-language translation of relevant portions).

* cited by examiner

COMPOSITE METAL MATERIAL AND METHOD OF PRODUCING THE SAME

Japanese Patent Application No. 2004-21146, filed on Jan. 29, 2004, is hereby incorporated by reference in its entirety.

BACKGROUND OF THE INVENTION

The present invention relates to a composite metal material and a method of producing the same.

In recent years, a composite metal material using a ceramic or the like as the reinforcing material has attracted attention. As such a composite metal material, an aluminum matrix composite material has been proposed (see Japanese Patent Application Laid-open No. 2002-115017, for example). As the fillers, particulate fillers (hereinafter called "filler particles") and fibrous filler are used.

As described above, the composite metal material using a ceramic or the like as the reinforcing material has been conventionally proposed. However, room for improvement still remains in dispersibility of the filler particles in the metal matrix. It is known that the compositing performance of the composite metal material is affected by wettability between the matrix metal and the reinforcing material and dispersibility of the reinforcing material in the matrix metal.

BRIEF SUMMARY OF THE INVENTION

According to a first aspect of the present invention, there is provided a method of producing a composite metal material, the method comprising:

(a) mixing an elastomer and filler particles to obtain a composite material; and (b) mixing the composite material and a metal to obtain a composite metal material in which the filler particles are uniformly dispersed in the metal.

According to a second aspect of the present invention, there is provided a composite metal material obtained by the above method.

DETAILED DESCRIPTION OF THE EMBODIMENT

Figure 1:
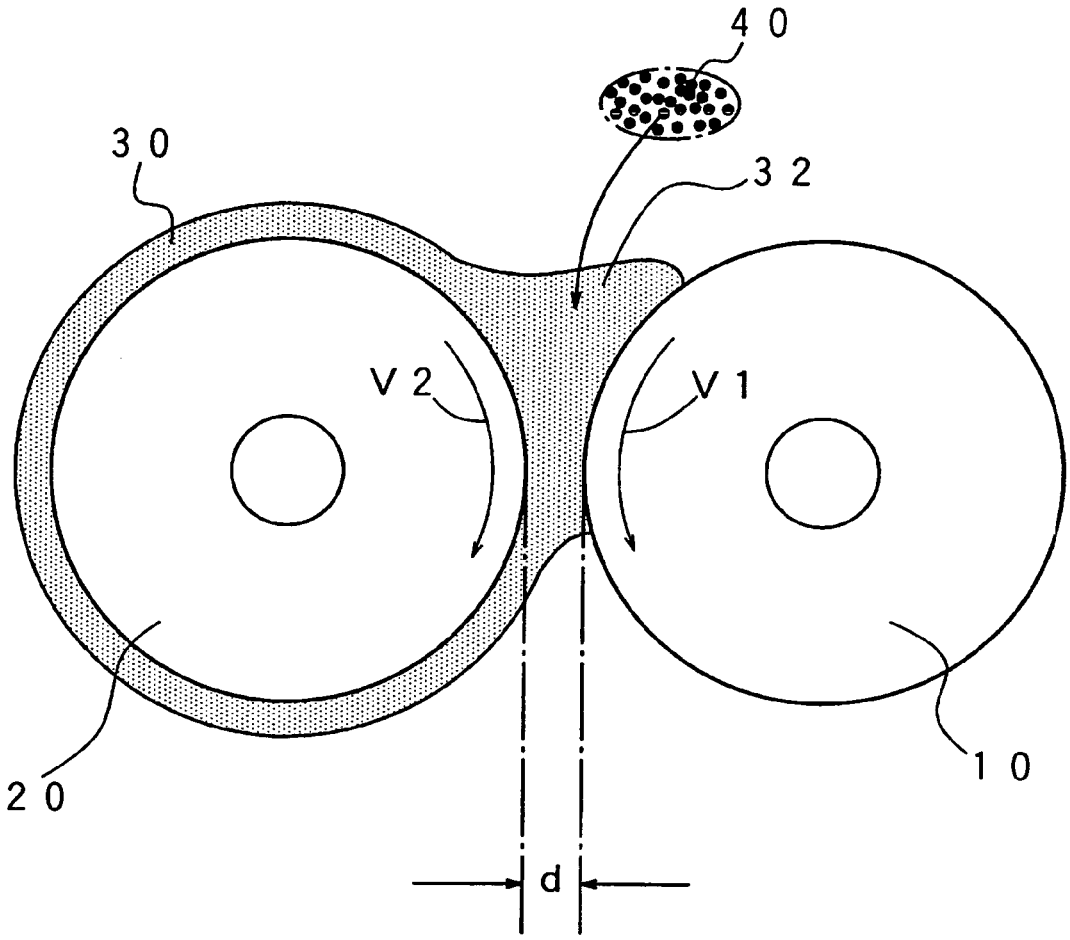
FIG. 1 is a diagram schematically showing a kneading method for an elastomer and filler particles using an open-roll method according to one embodiment of the present invention.

The following embodiment of the present invention may provide a composite metal material in which dispersibility of filler particles in a matrix metal is improved, and a method of producing the same.

According to one embodiment of the present invention, there is provided a method of producing a composite metal material, the method comprising:

(a) mixing an elastomer and filler particles to obtain a composite material; and (b) mixing the composite material and a metal to obtain a composite metal material in which the filler particles are uniformly dispersed in the metal.

In this production method, a composite material in which filler particles are uniformly dispersed in an elastomer can be obtained by mixing the elastomer and the filler particles, and a composite metal material in which filler particles are uniformly dispersed in a metal can be produced by using the composite material. The composite metal material in this embodiment thus obtained is an excellent material in which dispersibility of the filler particles is improved and which has a uniform compositing performance such as improved strength and improved abrasion resistance.

In this method of producing a composite metal material, the step (b) may include decomposing and removing the elastomer in the composite material when mixing the composite material and the metal.

This enables the elastomer unnecessary for the composition of the composite metal material to be decomposed and removed.

In this method of producing a composite metal material, the step (a) may include mixing and dispersing the filler particles in the elastomer by a shear force.

The filler particles can be comparatively easily dispersed in the elastomer by performing the step (a) in this manner. The step (a) of obtaining the composite material may be performed by a method such as:

(a-1) an open roll method with a roll interval of 0.5 mm or less;

(a-2) a closed kneading method with a rotor gap of 1 mm or less; or (a-3) a multi-screw extruding kneading method with a screw gap of 0.3 mm or less.

In this method of producing a composite metal material, the step (b) may be performed by a method such as:

(b-1) powder-forming the composite material;

(b-2) mixing the composite material and the metal in a fluid state, and causing the mixture to solidify; or (b-3) causing the metal that has been melted to permeate the composite material to replace the elastomer with the molten metal.

The filler particles used in this method may be metal filler particles or nonmetal filler particles. The nonmetal filler particles may be ceramic filler particles.

Since a metal the same as the matrix metal or its alloy or a metal having relatively excellent wettability with the matrix metal can be used as the metal filler particles, a desired compositing performance can be obtained. Since the nonmetal filler particles, in particular ceramic filler particles, excel in heat resistance, abrasion resistance, insulating properties, and the like, excellent characteristics as the composite metal material can be obtained.

The metal used in this method may be aluminum or an aluminum alloy.

The weight of the composite metal material can be reduced by using aluminum or an aluminum alloy.

The embodiment will be described below with reference to the drawings.

I. Filler Particles

As the filler particles used in this embodiment, nonmetal particles such as ceramic filler particles, metal filler particles, or a combination of these particles may be used. The ceramic filler particles excel in heat resistance, abrasion resistance, insulating properties, and the like.

As the nonmetal filler particles, organic filler materials, ceramic filler particles, and the like can be given. As the organic filler materials, a polyolefin, a polyester, a polyamide, a polyimide, a polyurethane, a mixture of these, or the like may be used. As the ceramic filler particles, alumina, silicon carbide, silicon nitride, magnesium oxide, a mixture of these, or the like may be used.

As the metal filler particles, chromium, copper, iron, nickel, or the like may be used.

The average particle diameter of the filler particles is preferably 1 nm to 300 μm, and still more preferably 100 nm to 50 μm in order to improve the strength of the composite metal material. The amount of filler particles to be added is not particularly limited, and may be set corresponding to the application. It is preferable that the amount be 1 to 50 vol % with respect to the metal material used for the composite metal material. If the amount is less than 1 vol %, the effect of the composite material cannot be obtained. If the amount exceeds 50 vol %, processing becomes difficult. The shape of the filler particle is not limited to globular, but may be flat or scaly.

As the metal filler particles, a metal or an alloy which forms a matrix in the step (b) may be used. When using a pressureless permeation method in the metal mixing step (b), the amount of filler particles is 10 to 3,000 parts by weight, and preferably 100 to 1,000 parts by weight for 100 parts by weight of the elastomer. If the amount of filler particles is less than 10 parts by weight, the permeation rate of a molten metal is decreased due to a small degree of capillary phenomenon, thereby giving rise to problems from the viewpoint of productivity and cost. If the amount of metal particles and ceramics particles exceeds 3,000 parts by weight, impregnation with the elastomer becomes difficult when producing a composite material.

The filler particles in this embodiment are used as a raw material when producing a composite material by mixing the filler particles with the elastomer, and producing a composite metal material using the composite material.

The filler particles may be provided with improved adhesion and wettability with the elastomer by subjecting the filler particles to a surface treatment such as an ion-injection treatment, sputter-etching treatment, or plasma treatment before kneading the filler particles and the elastomer or the metal material.

II. Elastomer Used in Step (a)

Since the filler particles are easily aggregated and are dispersed in the metal material to only a small extent, the filler particles are mixed with the elastomer to obtain a composite material in which the filler particles are dispersed in the elastomer. As the elastomer, an elastomer having a molecular weight of preferably 5,000 to 5,000,000, and still more preferably 20,000 to 3,000,000 is used. If the molecular weight of the elastomer is within this range, the elastomer molecules are entangled and linked, whereby the elastomer easily enters the space between the aggregated filler particles. Therefore, the effect of separating the filler particles is increased. If the molecular weight of the elastomer is less than 5,000, the elastomer molecules cannot be sufficiently entangled, whereby the effect of dispersing the filler particles is reduced even if a shear force is applied in the subsequent step. If the molecular weight of the elastomer is greater than 5,000,000, the elastomer becomes too hard, whereby processing becomes difficult.

The network component of the elastomer in a noncrosslinked form has a spin-spin relaxation time (T2n/30° C.) measured at 30° C. by a Hahn-echo method using a pulsed nuclear magnetic resonance (NMR) technique of preferably 100 to 3,000 μsec, and still more preferably 200 to 1,000 μsec. If the elastomer has the spin-spin relaxation time (T2n/30° C.) within the above range, the elastomer is flexible and has sufficiently high molecular mobility. Therefore, when the elastomer and the filler particles are mixed, the elastomer can easily enter the space between the filler particles due to high molecular mobility. If the spin-spin relaxation time (T2n/30° C.) is shorter than 100 μsec, the elastomer cannot have sufficient molecular mobility. If the spin-spin relaxation time (T2n/30° C.) is longer than 3,000 μsec, the elastomer tends to flow as a liquid, whereby it becomes difficult to disperse the filler particles.

A network component of the elastomer in a crosslinked form may preferably have a spin-spin relaxation time (T2n) measured at 30° C. by a Hahn-echo method using a pulsed nuclear magnetic resonance (NMR) technique of 100 to 2,000 μsec. The reasons therefor are the same as those for the above-mentioned noncrosslinked form. Specifically, when a noncrosslinked form which satisfies the above conditions is crosslinked according to the method of this embodiment, the spin-spin relaxation time (T2n) of the resulting crosslinked form almost falls within the above range.

The spin-spin relaxation time obtained by the Hahn-echo method using the pulsed NMR technique is a measure which represents molecular mobility of a substance. In more detail, when the spin-spin relaxation time of the elastomer is measured by the Hahn-echo method using the pulsed NMR technique, a first component having a first shorter spin-spin relaxation time (T2n) and a second component having a second longer spin-spin relaxation time (T2nn) are detected. The first component corresponds to the network component (backbone molecule) of the polymer, and the second component corresponds to the non-network component (branched component such as a terminal chain) of the polymer. The shorter the first spin-spin relaxation time, the lower the molecular mobility and the harder the elastomer. The longer the first spin-spin relaxation time, the higher the molecular mobility and the softer the elastomer.

As the measurement method in the pulsed NMR technique, a solid-echo method, a Carr-Purcell-Meiboom-Gill (CPMG) method, or a 90° pulse method may be applied in addition to the Hahn-echo method. However, since the composite material according to this embodiment has a medium spin-spin relaxation time (T2), the Hahn-echo method is most suitable. Generally, the solid-echo method and the 90° pulse method are suitable for the measurement of a short spin-spin relaxation time (T2), the Hahn-echo method is suitable for the measurement of a medium spin-spin relaxation time (T2), and the CPMG method is suitable for the measurement of a long spin-spin relaxation time (T2).

At least one of the main chain, the side chain, and the terminal chain of the elastomer may include at least one of a double bond, a triple bond, α-hydrogen, a carbonyl group, a carboxyl group, a hydroxyl group, an amino group, a nitrile group, a ketone group, an amide group, an epoxy group, an ester group, a vinyl group, a halogen group, a urethane group, a biuret group, an allophanate group, and a urea group as an unsaturated bond or a group.

As the elastomer, elastomers such as natural rubber (NR), epoxidized natural rubber (ENR), styrene butadiene rubber (SBR), nitrile rubber (NBR), chloroprene rubber (CR), ethylene propylene rubber (EPR or EPDM), butyl rubber (IIR), chlorobutyl rubber (CIIR), acrylic rubber (ACM), silicone rubber (Q), fluorine rubber (FKM), butadiene rubber (BR), epoxidized butadiene rubber (EBR), epichlorohydrin rubber (CO or CEO), urethane rubber (U), and polysulfide rubber (T); thermoplastic elastomers such as olefin-based elastomers (TPO), poly(vinyl chloride)-based elastomers (TPVC), polyester-based elastomers (TPEE), polyurethane-based elastomers (TPU), polyamide-based elastomers (TPEA), and polystyrene-based elastomers (SBS); and mixtures of these elastomers may be used.

The filler particles are generally easily aggregated and are dispersed in a medium to only a small extent. However, if the filler particles in this embodiment are used as a raw material for a composite metal material, since the filler particles are present in the elastomer in a dispersed state, the filler particles can be easily dispersed in a medium by mixing the raw material and the medium such as a metal.

III. Step (a) of Obtaining Composite Material by Mixing Filler Particles and Elastomer In the step (a) of obtaining the composite material, the following methods may be used while using the above-described filler particles and elastomer, for example:

(a-1) an open roll method with a roll interval of 0.5 mm or less;

(a-2) a closed kneading method with a rotor gap of 1 mm or less; and (a-3) a multi-screw extruding kneading method with a screw gap of 0.3 mm or less.

In this embodiment, an example in which the open roll method (a-1) with a roll interval of 0.5 mm or less is described as the step (a) of obtaining the composite material.

Since it is difficult to disperse the filler particles, it is preferable that the elastomer have the features described in II, for example.

FIG. 1 is a view schematically showing the open-roll method using two rolls. In FIG. 1, a reference numeral 10 indicates a first roll, and a reference numeral 20 indicates a second roll. The first roll 10 and the second roll 20 are disposed at a predetermined distance d of preferably 1.0 mm or less, and still more preferably 0.1 to 0.5 mm. The first and second rolls are rotated normally or reversely. In the example shown in FIG. 1, the first roll 10 and the second roll 20 are rotated in the directions indicated by the arrows. When the surface velocity of the first roll 10 is indicated by V1 and the surface velocity of the second roll 20 is indicated by V2, the surface velocity ratio (V1/V2) of the first roll 10 to the second roll 20 is preferably 1.05 to 3.00. A desired shear force can be obtained by using such a surface velocity ratio. When an elastomer 30 is wound around the second roll 20 in a state in which the first and second rolls are rotated, a bank 32 in which the elastomer is deposited between the rolls 10 and 20 is formed.

Filler particles 40 are added to the bank 32 in which the elastomer 30 has been deposited, and the first and second rolls 10 and 20 are rotated. The distance between the first and second rolls 10 and 20 is reduced to the distance d, and the first and second rolls 10 and 20 are rotated at the above-mentioned predetermined surface velocity ratio. This causes a high shear force to be applied to the elastomer 30. The aggregated filler particles are separated by the shear force, and dispersed in the elastomer 30.

In the step (a) of obtaining the composite material, it is preferable that the filler particles and the elastomer be kneaded at a shear force as high as possible. In this step, the elastomer and the filler particles are mixed at a comparatively low temperature of preferably 0 to 50° C., and still more preferably 5 to 30° C. in order to obtain a shear force as high as possible. In the case of using the open-roll method, it is preferable to set the roll temperature at the above temperature.

In this embodiment, the elastomer having an appropriately long molecular length and high molecular mobility enters the space between the filler particles. When a high shear force is applied to the mixture of the elastomer and the filler particles, the filler particles move accompanying the movement of the elastomer, whereby the aggregated filler particles are separated and dispersed in the elastomer. As a result, the filler particles in the composite material can have excellent dispersion stability.

The step (a) of obtaining the composite material may be performed by using the above-mentioned closed kneading method (a-2) or multi-screw extrusion kneading method (a-3) in addition to the open roll method (a-1). In other words, it suffices that this step apply a shear force to the elastomer sufficient to separate the aggregated filler particles.

A composite material obtained by the step of mixing and dispersing the filler particles in the elastomer (mixing and dispersing step) may be crosslinked using a crosslinking agent and formed into a desired shape, or may be formed without crosslinking the composite material. The composite material thus obtained may produce a composite metal material by the step (b).

In the mixing and dispersing step of the elastomer and the filler particles or in the subsequent step, additives usually used for processing elastomers such as rubber may be added. As the additives, conventional additives may be used. Examples of additives include a crosslinking agent, a vulcanizing agent, a vulcanization accelerator, a vulcanization retarder, a softener, a plasticizer, a curing agent, a reinforcing agent, a filler, an aging preventive, a colorant, and the like.

IV. Step (b) of Obtaining Composite Metal Material

In the step (b) of obtaining the composite metal material, the following forming methods may be used while using the composite material obtained in the step (a), for example:

(b-1) a method of powder-forming the composite material;

(b-2) a method of mixing the composite material with the metal in a fluid state and causing the mixture to solidify; and (b-3) a method of causing the molten metal to permeate the composite material to replace the elastomer with the molten metal.

For example, in the method (b-1), a composite metal material may be obtained by compressing the composite material obtained in the step (a) or frozen and ground particles of the composite material in a die, and sintering the compressed product at a metal sintering temperature (550° C. in the case of aluminum, for example). Therefore, the powder-forming in this embodiment includes powder metallurgy. The powder-forming in this embodiment includes not only the case of using a powdered raw material, but also the case of using a raw material formed in the shape of a block by compression preforming the composite material.

For example, the frozen and ground particles of the composite material obtained in the step (a) and particles of another metal which become the matrix of the composite metal material may be mixed (dry-blended or wet-blended, for example) and sintered using the sintering method to obtain a composite metal material.

The frozen and ground particles of the composite material and particles of another metal may be mixed (dry-blended, for example), compression-formed in a die, and sintered to obtain a composite metal material. As the sintering method, a generally-used sintering method, a spark plasma sintering method (SPS) using a plasma sintering device, or the like may be employed.

Particles of another metal and the particles of the composite material may be mixed (dry-blended, for example), and a composite metal material may be obtained by using a powder forging method or a powder injection method. The composite metal material produced by such powder-forming allows the filler particles to be dispersed in the metal material. It is preferable that the particles of another metal used in this step be the same material as the particles of the metal used to obtain the composite metal material. The size of the particles may be arbitrarily selected depending on the application of the composite material obtained by powder-forming or the like.

As the step (b-2), the composite material obtained in the step (a) and a metal in a fluid state (molten metal) are mixed and caused to solidify to obtain a composite metal material, for example. In such a casting step, the composite material and the molten metal are mixed first. Specifically, a metal such as aluminum is dissolved (650 to 800° C.) in a crucible, and the composite material is placed in the crucible while stirring the dissolved aluminum to mix the aluminum and the composite material. The stirring may be caused by rotation in one direction. However, the mixing effect is increased by stirring the mixture in three directions (three dimensions). The molten aluminum metal mixed in an air atmosphere or inert atmosphere may be cast using a metal mold casting method, a diecasting method, or a low-pressure diecasting method, in which the molten metal is poured into a die made of steel, for example. A method classified as a special casting method, such as a high-pressure casting method (squeeze casting) in which a molten metal is caused to solidify at a high pressure, a thixocasting method in which a molten metal is stirred, or a centrifugal casting method in which a molten metal is cast in a die by utilizing a centrifugal force may also be employed. In the above casting method, the molten metal is caused to solidify in a die in a state in which the composite material is mixed into the molten metal to form a composite metal material having a desired shape.

In thixocasting, it is preferable that aluminum be dissolved at 700 to 800° C., the temperature be lowered while stirring the dissolved aluminum to obtain a thixotropic state at 400 to 600° C., and the composite material be mixed in this state. Since the viscosity is increased in the thixotropic state, uniform dispersion can be achieved. It is preferable to perform the casting step in an inert atmosphere, such as a nitrogen atmosphere, a weak reducing atmosphere in which a small amount of hydrogen gas is added to nitrogen, or under vacuum, since the molten metal (molten aluminum metal, for example) is prevented from being oxidized to exhibit higher wettability with the filler particles. In this casting step, the elastomer in the composite material is decomposed and removed by the heat from the molten metal.

The composite metal material obtained by the above production method may be used as an ingot and formed into a desired form by using a casting method, a powder forging method, a powder extrusion forming method, or a powder injection forming method, for example.

The composite metal material produced by such a casting method allows the filler particles to be dispersed in the metal material.

In this embodiment, the casting step (b-3) using a pressureless permeation method in which the molten metal is caused to permeate the composite material obtained in the step (a) is described below in detail with reference to FIGS. 2 and 3.

Figure 2:
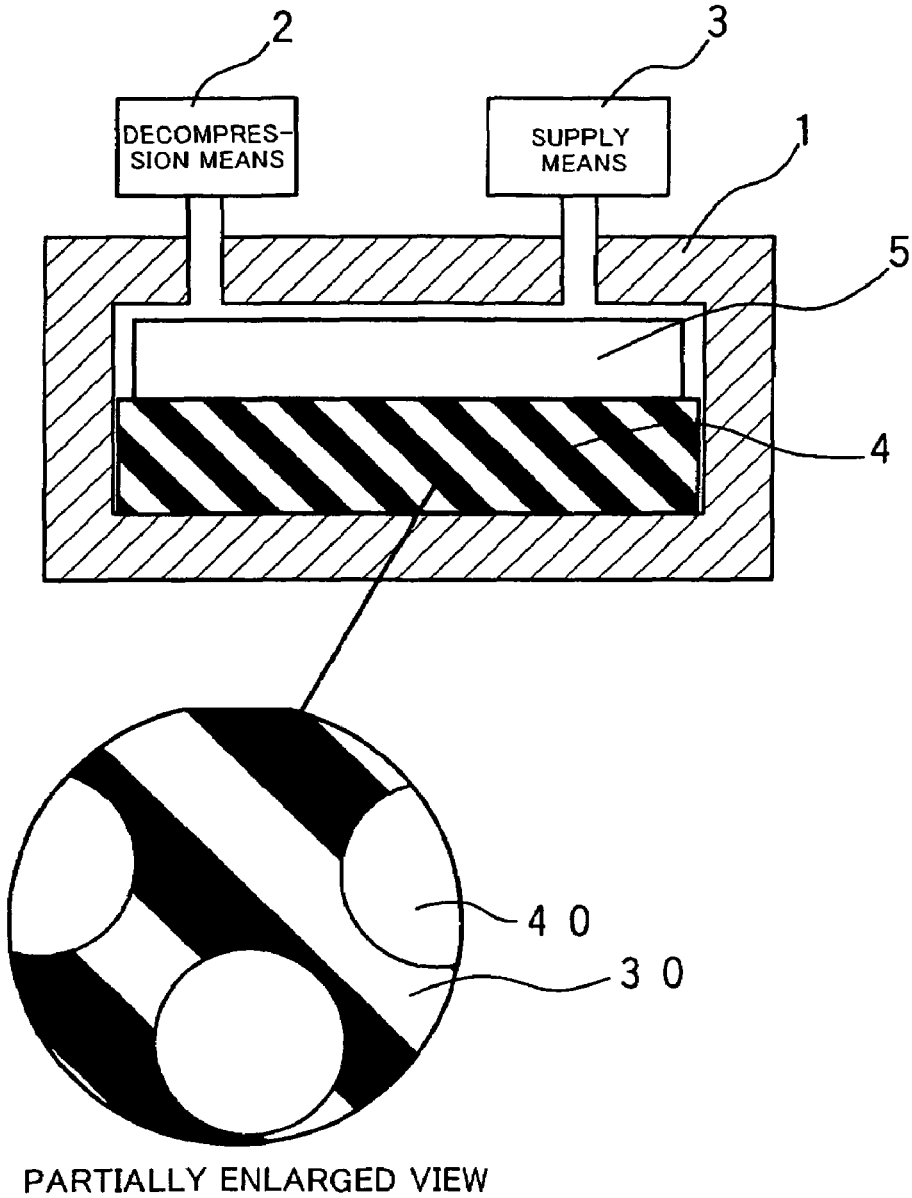
FIG. 2 is a diagram schematically showing a device for producing a composite metal material using a pressureless permeation method.
Figure 3:
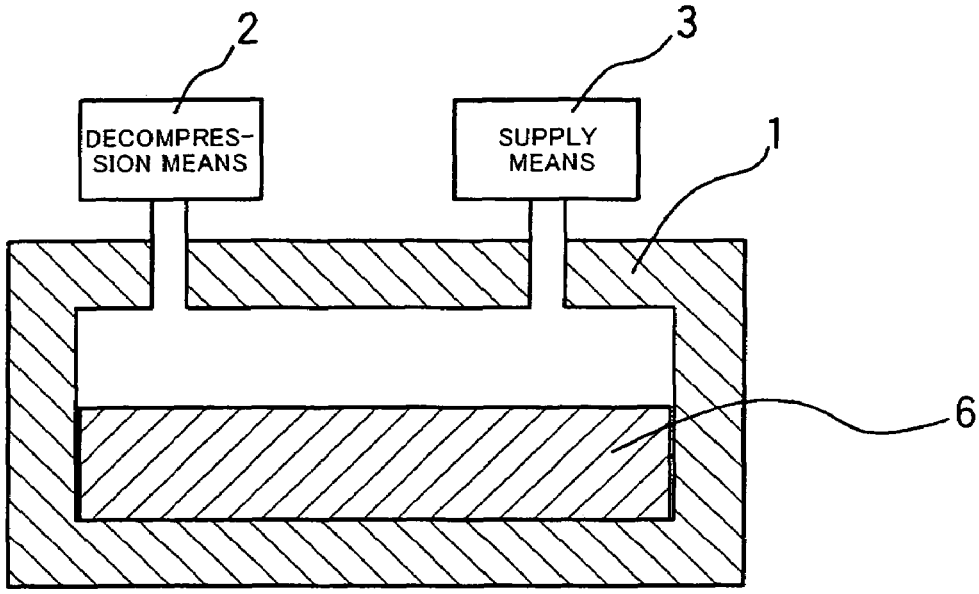
FIG. 3 is a diagram schematically showing a device for producing a composite metal material using a pressureless permeation method.

FIGS. 2 and 3 are schematic configuration diagrams of a device for producing the composite metal material by using the pressureless permeation method. As the composite material obtained in the step (a), a composite material 4 which is compression-formed in a forming die having a shape of the final product may be used, for example. It is preferable that the composite material 4 be not crosslinked. If the composite material 4 is not crosslinked, the permeation rate of the molten metal is increased. In FIG. 2, the composite material 4 such as a composite material 4 in which the filler particles 40 are mixed into the noncrosslinked elastomer 30 is placed in a sealed container 1. As shown in the enlarged diagram in FIG. 2, the composite material 4 is formed in a state in which the filler particles 40 are dispersed in the matrix of the elastomer 30. A metal ingot such as an aluminum ingot 5 is disposed on the composite material 4. The composite material 4 and the aluminum ingot 5 disposed in the container 1 are heated to a temperature equal to or higher than the melting point of aluminum by using a heating means (not shown) provided at the container 1. The heated aluminum ingot 5 melts to become a molten aluminum metal (molten metal). The elastomer 30 in the composite material 4 which is in contact with the molten aluminum metal is decomposed and vaporized, and the molten aluminum metal (molten metal) permeates the space formed by decomposition of the elastomer 30.

In the composite material 4, the space formed by decomposition of the elastomer 30 allows the molten aluminum metal to permeate the entire formed product due to a capillary phenomenon. The molten aluminum metal permeates the elastomer 30 by the capillary phenomenon, whereby the composite material is completely filled with the molten aluminum metal.

The heating by the heating means of the container 1 is then terminated, and the molten metal which has permeated the composite material 4 is allowed to cool and solidify to obtain a composite metal material 6 as shown in FIG. 3 in which the filler particles 40 are uniformly dispersed.

In FIG. 2, the atmosphere inside the container 1 may be removed by a decompression means 2 such as a vacuum pump connected with the container 1 before heating the container 1. Nitrogen gas may be introduced into the container 1 from an inert-gas supply means 3 such as a nitrogen gas cylinder connected with the container 1.

In the case of using aluminum as the molten metal, the surface of the aluminum ingot 5 is covered with an oxide. When the molten aluminum metal is caused to permeate, the molecular end of the thermally decomposed elastomer becomes a radical, and the oxide (alumina) on the surface of the molten aluminum metal is reduced by the radical. In this embodiment, since the reducing atmosphere can be generated even inside the composite material by decomposition of the elastomer included in the composite material, the casting process using the pressureless permeation method can be performed without providing a reducing atmosphere processing chamber as in a conventional method. The reducing effect may be promoted by mixing magnesium particles in the composite material in advance as the reducing agent.

The surfaces of the filler particles are activated by the radicals of the elastomer molecules decomposed by permeation of the molten aluminum metal, whereby wettability with the molten aluminum metal is improved. The composite metal material thus obtained includes the filler particles uniformly dispersed in the aluminum matrix.

The pressureless permeation method is described as the step (b-3). However, a pressure permeation method which pressurizes the material by the pressure of inert gas atmosphere may also be used, for example.

According to the permeation method in the step (b-3), since the elastomer in the composite material is replaced by the metal material, the dispersion state of the filler particles is uniform in comparison with another casting method. Therefore, the permeation method is relatively advantageous.

The metal used in the casting step (b) may be appropriately selected from metals used in a conventional powder-forming and casting process, such as iron and an iron alloy, aluminum and an aluminum alloy, titanium and a titanium alloy, magnesium and a magnesium alloy, copper and a copper alloy, and zinc and a zinc alloy, either individually or in combination of two or more depending on the application.

Examples according to the present invention and Comparative Examples are described below. Note that the present invention is not limited to the following examples.

(1) Noncrosslinked Composite Material

Step 1: An open roll with a roll diameter of six inches (roll temperature: 10 to 20° C.) was provided with a predetermined amount (100 g) (100 parts by weight (phr)) of an elastomer shown in Table 1, and the elastomer was wound around the roll. As the elastomer, natural rubber (NR) with a molecular weight of 3,000,000 was used.

Step 2: Filler particles were added to the elastomer in an amount (parts by weight) shown in Table 1. The roll distance was set at 1.5 mm. As the filler particles, alumina (average particle diameter: 38 μm), SiC (average particle diameter: 45 μm), and tungsten (average particle diameter: 150 μm) were used.

Step 3: After the addition of the filler particles, the mixture of the elastomer and the filler particles was removed from the rolls.

Step 4: The roll distance was reduced from 1.5 mm to 0.3 mm, and the mixture was positioned in the open roll and tight milled. The surface velocity ratio of the two rolls was set at 1.1. The tight milling was repeated ten times.

Step 5: The rolls were set at a predetermined distance (1.1 mm), and the mixture which had been tight milled was positioned and sheeted.

Noncrosslinked composite materials of Examples 1 to 3 were obtained in this manner.

(2) Composite Metal Material

The noncrosslinked composite material obtained in (1) was disposed in a container (furnace). An aluminum ingot (metal) was placed on the noncrosslinked composite material, and the composite material and the aluminum ingot were heated to the melting point of aluminum in an inert gas (nitrogen) atmosphere. The aluminum ingot melted to become a molten aluminum metal. The molten metal permeated the composite material to replace the elastomer in the composite material. After permeation of the molten aluminum metal was completed, the molten aluminum metal was allowed to cool and solidify to obtain composite metal materials of Examples 1 to 3.

As Comparative Example 1, a composite metal material sample obtained by adding filler particles to a molten aluminum metal in an amount shown in Table 1, stirring the mixture, and casting the stirred mixture was used.

As Comparative Example 2, only aluminum was used.

An aluminum alloy AC3C was used as the aluminum ingot in Examples 1 to 3 and Comparative Examples 1 and 2.

(3) Measurement of Tensile Strength

The composite metal material samples of Examples 1 to 3 and Comparative Examples 1 and 2, 10 pieces each, were subjected to a tensile test to determine the maximum value, the minimum value, and the average value of tensile strength. The results are shown in Table 1.

TABLE 1

| | | Example | | | Comparative Example | |
|---|---|---|---|---|---|---|
| | | 1 | 2 | 3 | 1 | 2 |
| Raw material elastomer | Polymer substance | NR | NR | NR | (Aluminum and particle) | (Aluminum) |
| | Average molecular weight | 3,000,000 | 3,000,000 | 3,000,000 | — | — |
| | T2n (30° C.) (μsec) | 700 | 700 | 700 | — | — |
| | T2n (150° C.) (μsec) | 5500 | 5500 | 5500 | — | — |
| | T2nn (30° C.) (μsec) | 18000 | 18000 | 18000 | — | — |
| | fnn (30° C.) | 0.381 | 0.381 | 0.381 | — | — |
| Amount of polymer substance and filler particles | Polymer (phr) | 100 | 100 | 100 | — | — |
| | Alumina particle (phr) | 111 | 0 | 0 | — | — |
| | SiC particle (phr) | 0 | 92 | 0 | — | — |
| | Tungsten particle (phr) | 0 | 0 | 536 | — | — |
| Ratio of filler particles and matrix metal | Filler particle (vol %) | 20 (alumina) | 20 (SiC) | 20 (tungsten) | 20 (alumina) | — |
| | Aluminum alloy AC3C (vol %) | 80 | 80 | 80 | 80 | 100 |
| Composite metal material | Maximum value (MPa) | 960 | 1400 | 1120 | 610 | 305 |
| | Minimum value (MPa) | 780 | 1150 | 920 | 300 | 210 |
| | Average value (MPa) | 870 | 1280 | 1020 | 510 | 255 |

From the results shown in Table 1, it was found that the tensile strength was nonuniform depending on the sample in Comparative Example 1, and that the tensile strength was almost uniform in Examples 1 to 3.

Therefore, according to the examples of the present invention, it was found that the filler particles, which can be generally dispersed in a matrix to only a small extent, can be uniformly dispersed in the metal matrix.

From the results shown in Table 1, it was also found that the tensile strength of Examples 1 to 3 was higher than the tensile strength of Comparative Example 2.

Therefore, according to the examples of the present invention, it was found that the strength of the composite metal material was improved in comparison with the non-composite metal substance.

Although only some examples of the present invention have been described in detail above, those skilled in the art will readily appreciate that many modifications are possible without departing from the novel teachings and advantages of this invention. Accordingly, all such modifications are intended to be included within the scope of this invention.

What is claimed is:

1. A method of producing a composite metal material, the method comprising:

(a) mixing an elastomer and filler particles to obtain a composite material; and (b) mixing the composite material and a metal to obtain a composite metal material in which the filler particles are uniformly dispersed in the metal;

wherein:

a network component of the elastomer in a noncrosslinked form has a spin-spin relaxation time (T2n) measured at 30° C. by a Hahn-echo method using a pulsed nuclear magnetic resonance (NMR) technique of 100 to 3,000 μsec.

2. The method according to claim 1, wherein:

step (b) includes decomposing and removing the elastomer in the composite material when mixing the composite material and the metal.

3. The method according to claim 1, wherein:

step (a) includes mixing and dispersing the filler particles in the elastomer by a shear force.

4. The method according to claim 1, wherein:

step (b) includes powder-forming the composite material.

5. The method according to claim 1, wherein:

step (b) includes mixing the composite material and the metal in a fluid state, and causing the mixture to solidify.

6. The method according to claim 1, wherein:

step (b) includes melting the metal and causing the molten metal to permeate the composite material to replace the elastomer with the molten metal.

7. The method according to claim 1, wherein the filler particles are metal filler particles.

8. The method according to claim 1, wherein the filler particles are nonmetal filler particles.

9. The method according to claim 8, wherein the nonmetal filler particles are ceramic filler particles.

10. The method according to claim 1, wherein the elastomer has a molecular weight of 5,000 to 5,000,000.

11. The method according to claim 1, wherein:

at least one of a main chain, a side chain, and a terminal chain of the elastomer includes at least one of a double bond, a triple bond, an α-hydrogen, a carbonyl group, a carboxyl group, a hydroxyl group, an amino group, a nitrile group, a ketone group, an amide group, an epoxy group, an ester group, a vinyl group, a halogen group, a urethane group, a biuret group, an allophanate group, and a urea group.

12. The method according to claim 1, wherein:

a network component of the elastomer in a crosslinked form has a spin-spin relaxation time (T2n) measured at 30° C. by a Hahn-echo method using a pulsed nuclear magnetic resonance (NMR) technique of 100 to 2,000 μsec.

13. The method according to claim 1, wherein the metal is aluminum or an aluminum alloy.

14. A composite metal material obtained by the method as defined in claim 1.

* * * * *